US007641743B2

(12) United States Patent
Pearce et al.

(10) Patent No.: US 7,641,743 B2
(45) Date of Patent: Jan. 5, 2010

(54) COMPOSITIONS AND METHODS FOR DARKENING AND IMPARTING CORROSION-RESISTANT PROPERTIES TO ZINC OR OTHER ACTIVE METALS

(75) Inventors: Michelle R. Pearce, Chardon, OH (US); Brian G. Straka, Painesville, OH (US); Donald J. Guhde, Euclid, OH (US); Terry E. Dorsett, Chardon, OH (US)

(73) Assignee: Metal Coatings International Inc., Chardon, OH (US)

( * ) Notice: Subject to any disclaimer, the term of this patent is extended or adjusted under 35 U.S.C. 154(b) by 670 days.

(21) Appl. No.: 10/559,197

(22) PCT Filed: Jun. 4, 2004 (Under 37 CFR 1.47)

(86) PCT No.: PCT/US2004/017786

§ 371 (c)(1), (2), (4) Date: Mar. 31, 2006

(87) PCT Pub. No.: WO2004/108407

PCT Pub. Date: Dec. 16, 2004

(65) Prior Publication Data

US 2006/0213389 A1 Sep. 28, 2006

(51) Int. Cl.

| | |
|---|---|
| ***C23C 22/68*** | (2006.01) |
| ***C23C 22/78*** | (2006.01) |
| ***C23C 22/83*** | (2006.01) |
| ***C23C 22/05*** | (2006.01) |
| ***C23F 11/18*** | (2006.01) |
| ***C09K 15/02*** | (2006.01) |

(52) U.S. Cl. ..... 148/243; 148/275; 148/285; 148/513; 148/666; 148/705; 252/387; 252/397; 427/433; 420/531; 106/1.17; 106/1.05; 106/1.22; 106/14.05; 106/14.21; 106/14.24; 106/14.33; 106/14.39

(58) Field of Classification Search ..... 252/387, 252/397; 148/243, 275, 285
See application file for complete search history.

(56) References Cited

U.S. PATENT DOCUMENTS 2,554,256 A * 5/1951 Lewis et al. ..... 148/273

(Continued)

FOREIGN PATENT DOCUMENTS

EP 0915 747 12/2001

(Continued)

OTHER PUBLICATIONS

Lienard et al., "Analysis of the Mechanism of Selective Coloration Facilitating the Identification of Various Phases in Aluminum-Silicon-copper Casting Alloys," Homes Et Fonderie, Jun.-Jul., 1982, pp. 27-35 and English Translation.

*Primary Examiner*—Joseph D Anthony
(74) *Attorney, Agent, or Firm*—Rankin, Hill & Clark LLP

(57) ABSTRACT

Methods and compositions that serve to both darken a zinc or other active! metal surface and impart corrosion-resistant properties thereto, are disclosed. The compositions include an aqueous solution containing about 0.1 percent to about 5 percent ammonium chloride and about 0.1 percent to about 5 percent ammonium molybdate. The compositions utilize particular ratios of concentrations of ammonium chloride and ammonium molybdate.

12 Claims, 6 Drawing Sheets

U.S. PATENT DOCUMENTS

| | | | | | |
|---|---|---|---|---|---|
| 2,679,475 | A | * | 5/1954 | Singler | 205/246 |
| 3,314,811 | A | * | 4/1967 | Mitchell et al. | 427/435 |
| 3,650,957 | A | | 3/1972 | Shipley, Jr. et al. | |
| 3,920,488 | A | * | 11/1975 | Pitton | 148/272 |
| 4,018,628 | A | | 4/1977 | Paulet | |
| 4,176,059 | A | | 11/1979 | Suzuki | |
| 4,217,216 | A | | 8/1980 | Lipinski | |
| 4,266,975 | A | * | 5/1981 | Higashiyama et al. | 106/1.12 |
| 4,409,121 | A | | 10/1983 | Latos et al. | |
| 4,440,721 | A | | 4/1984 | Wilson et al. | |
| 4,548,787 | A | | 10/1985 | Wilson et al. | |
| 4,640,793 | A | | 2/1987 | Persinski et al. | |
| 4,798,683 | A | | 1/1989 | Boffardi et al. | |
| 5,700,334 | A | * | 12/1997 | Ishii et al. | 148/273 |
| 6,866,457 | B2 | * | 3/2005 | Wilson | 411/431 |
| 2002/0146301 | A1 | * | 10/2002 | Wilson | 411/429 |
| 2004/0142162 | A1 | * | 7/2004 | Maze et al. | 428/323 |
| 2004/0191555 | A1 | * | 9/2004 | Germano | 428/553 |
| 2006/0213389 | A1 | * | 9/2006 | Pearce et al. | 106/14.05 |

FOREIGN PATENT DOCUMENTS

| | | |
|---|---|---|
| SU | 827613 | 5/1981 |
| SU | 1678900 | 9/1991 |

* cited by examiner

Room Temperature Bath/Air Dry

150°F Bath/Air Dry

Room Temperature Bath/350°F Dry

RFN-01-1-PT Baked 350°F

Post-Treatments over GEOMET

First Red Rust

COMPOSITIONS AND METHODS FOR DARKENING AND IMPARTING CORROSION-RESISTANT PROPERTIES TO ZINC OR OTHER ACTIVE METALS

FIELD OF THE INVENTION

The present invention relates to bifunctional coatings for zinc and other active metals. The coatings serve to darken the surface of the zinc and impart anti-corrosion properties to the coated product.

BACKGROUND OF THE INVENTION

Compositions for coating industrial components and assemblies are becoming increasingly important. For example, many mechanical parts and fasteners are coated with a composition to improve the aesthetics and overall appearance of the part or fastener, particularly when the part is visible in the final assembled product. Additionally, mechanical fasteners such as bolts or screws may be colored to simplify assembly or disassembly of a manufactured product. These compositions often contain pigments or other coloring agents as desired, to impart a certain color or appearance to the coated part.

Many mechanical components used in automobiles are coated with a darkening paint or composition to impart a black, gray, or dark finish. Since many mechanical components must, as a result of strength requirements, be metal; without such coatings, the metallic components are silver or at least shiny in appearance. In order to impart a black or dark appearance to such components, it is necessary to apply a suitable coating.

Various compositions are known for imparting a black or dark color to a metallic part. Many of these compositions are commercially available. However, for many applications, in order to effectively cover the silver and shiny metallic surface of the part, multiple coats of the coloring coating must be applied. This is undesirable because such compositions are often relatively expensive. And, multiple coating operations are labor intensive. Accordingly, there is a need for a technique to reduce the expense otherwise associated with the use of these coloring coatings.

In addition to applying a composition to color a metallic part, other compositions are often applied to the part to impart other physical characteristics. Corrosion resistance is a desirable property for metallic parts, and particularly for such parts used in automotive applications. The art is replete with a wide variety of compositions for imparting corrosion-resistant properties to a metal surface. Coating compositions have evolved along with the changing technology of alloys and understanding of the science of corrosion.

A factor affecting the evolution of corrosion-inhibiting compositions is the relative toxicity or environmental impact of the composition or its components. For this reason, molybdate has been investigated as a suitable anti-corrosion agent, and particularly as a replacement for toxic chromium or chromium-based compounds.

Molybdenum and compounds thereof have long been recognized as corrosion inhibitors. For example, U.S. Pat. No. 4,409,121, herein incorporated by reference, describes corrosion inhibiting compositions containing a molybdate salt. In the background section of that patent, the '121 patent notes other patents directed to corrosion inhibiting compositions containing molybdate such as U.S. Pat. Nos. 4,176,059 and 4,217,216; both of which are hereby incorporated by reference.

Similarly, U.S. Pat. No. 4,440,721, herein incorporated by reference, describes compositions for inhibiting mineral scale and corrosion in the presence of aqueous liquids. The compositions of the '721 patent include one or more water-soluble molybdate compounds. Other patents directed to aqueous compositions containing molybdenum compounds include U.S. Pat. Nos. 3,030,308; 2,147,409; and 2,147,395; all of which are hereby incorporated by reference. These compositions are however, generally directed to anti-freeze compositions.

Further investigation into the corrosion inhibiting properties of molybdate led to U.S. Pat. No. 4,548,787, herein incorporated by reference. The '787 patent describes a composition that protects against cavitation-erosion and corrosion of aluminum in aqueous liquids. That composition is based upon the combination of a phosphate and certain water-soluble agents which may include a water-soluble molybdate compound.

Additional mention was made of the use of water-soluble salts of molybdenum in corrosion inhibiting mixtures based on a particular class of polymers, in U.S. Pat. No. 4,640,793, herein incorporated by reference.

Perhaps the most relevant prior work in the patent literature is U.S. Pat. No. 4,798,683, herein incorporated by reference. The '683 patent is directed to methods of controlling corrosion by the use of molybdate compositions. Specifically, the '683 patent describes methods and compositions for inhibiting the corrosion of metallic surfaces in contact with aqueous systems. The compositions of the '683 patent contain a molybdate ion source and certain water-soluble components. The '683 patent discloses molybdate ion sources as including magnesium molybdate, ammonium molybdate, lithium molybdate, sodium molybdate, and potassium molybdate.

Another interesting, although less relevant, prior work involving molybdate compositions is by Philippe Lienard and Clement Pacque entitled, "Analysis of the Mechanism of Selective Coloration Facilitating the Identification of Various Phases in Aluminum-Silicon-Copper Casting Alloys," Homes Et Fonderie, June-July 1982, p. 27-35. In that paper, an aqueous composition of 0.5 weight percent ammonium heptamolybdate and 3 weight percent ammonium chloride was used to emphasize and highlight grain boundaries in various alloys that were the subject of their work. There was no attempt to impart corrosion inhibiting properties to the alloys under review by the aqueous molybdate composition.

Although satisfactory in many respects, much of the prior art is directed to applications involving corrosion control in heat transfer systems and not to coating compositions for corrosion control. The two applications have significantly different criteria. Additionally, many of the prior art anti-corrosion compositions contain numerous other agents, many of which are exotic, costly, or highly toxic. Accordingly, there remains a need for a composition and method for readily imparting corrosion resistance to a metal surface. Moreover, prior art anti-corrosion compositions do not address the concerns over improving the aesthetics of metallic parts and fasteners, and particularly imparting a black or dark color to the coated part. The previously noted work by Lienard and Pacque was not directed to providing a dark surface to a metal. Moreover, Lienard and Pacque never described any aspect concerning a corrosion inhibiting composition for their alloy. Instead, they used the noted molybdate composition to render grain boundaries of an aluminum-silicon-copper alloy more visible, i.e. to increase the contrast between certain regions of a metal surface. Accordingly, it would be desirable to provide a composition and method for readily darkening a metallic surface. Moreover, it would be desirable to provide a composition and technique for reducing the contrast between a shiny or silvery metal surface and a dark pigmented or colored top coat. Furthermore, it would be particularly desirable to provide a composition and method for simultaneously imparting anti-corrosion, or at least corrosion-resistant properties and darkening the outer surface of a metal part.

SUMMARY OF THE INVENTION

In a first aspect, the present invention provides a composition comprising from about 0.1 percent to about 5 percent ammonium chloride, from about 0.1 percent to about 5 percent ammonium molybdate, and from about 90 percent to about 99.8 percent water. The composition also utilizes particular ratios of ammonium chloride to ammonium molybdate. Generally the ratio of these components is from about 1:3 to about 3:1, respectively.

In another aspect, the present invention provides an aqueous composition comprising from about 0.1 percent to about 5 percent ammonium chloride and from about 0.1 percent to about 5 percent ammonium heptamolybdate. The ratio of ammonium chloride to ammonium heptamolybdate is from about 1:3 to about 3:1.

In another aspect, the present invention provides a coated metallic substrate comprising a metal substrate having an outer surface wherein the metal is selected from the group consisting of zinc, magnesium, aluminum, manganese, and alloys thereof. The coated metallic substrate also comprises a darkening coating disposed on the substrate in which the coating is formed from an aqueous composition comprising (i) from about 0.1 percent to about 5 percent ammonium chloride, and (ii) from about 0.1 percent to about 5 percent ammonium molybdate. The ratio of ammonium chloride to ammonium molybdate is from about 1:3 to about 3:1.

In another aspect, the present invention provides a method for darkening the surface of zinc comprising providing a substrate having an outer surface of zinc and providing a composition including from about 0.1 percent to about 5 percent ammonium chloride and from about 0.1 percent to about 5 percent ammonium molybdate. The method also comprises a step of applying the composition to the outer surface of the zinc to form a darkening coating thereon.

In a further aspect, the present invention provides a method for imparting corrosion inhibiting properties to a substrate of an active metal. The method comprises providing a substrate of an active metal. The method also comprises a step of providing a composition including from about 0.1 percent to about 5 percent ammonium chloride and from about 0.1 percent to about 5 percent ammonium molybdate. The ratio of ammonium chloride to ammonium molybdate is from about 1:3 to about 3:1. The method also comprises a step of applying a composition to the substrate.

In yet another aspect, the present invention provides a method for imparting corrosion resistance properties to a zinc surface. The method comprises providing a component having an outer surface of zinc. The method also comprises a step of providing a composition including from about 0.1 percent to about 5 percent ammonium chloride and from about 0.1 percent to about 5 percent ammonium molybdate. The method also comprises a step of applying the composition to the outer surface of the zinc.

DESCRIPTION OF THE PREFERRED EMBODIMENTS

Figure 1:
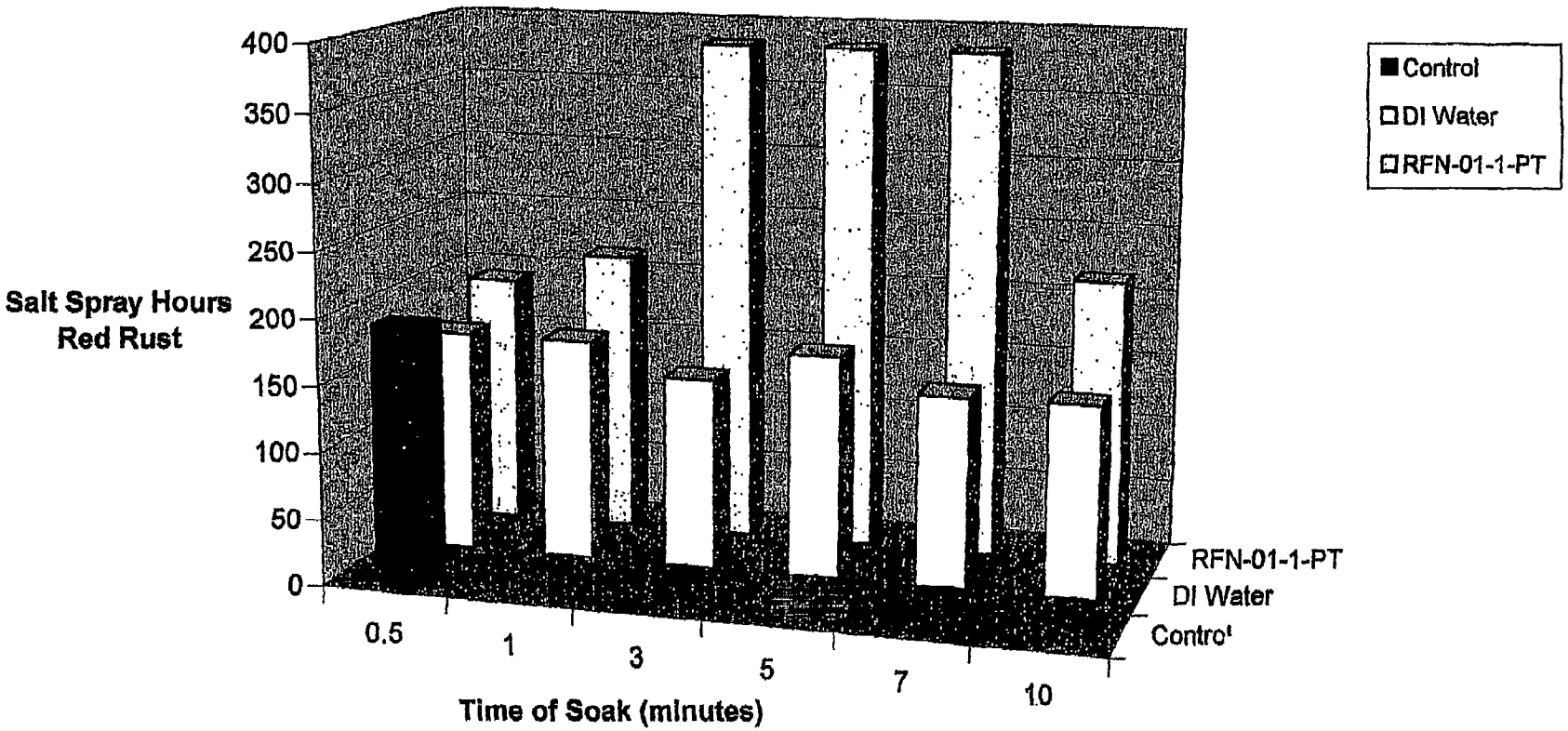
FIG. 1 is a graph illustrating corrosion resistance of metal samples soaked and coated for various time periods at room temperature and air dried.
Figure 2:
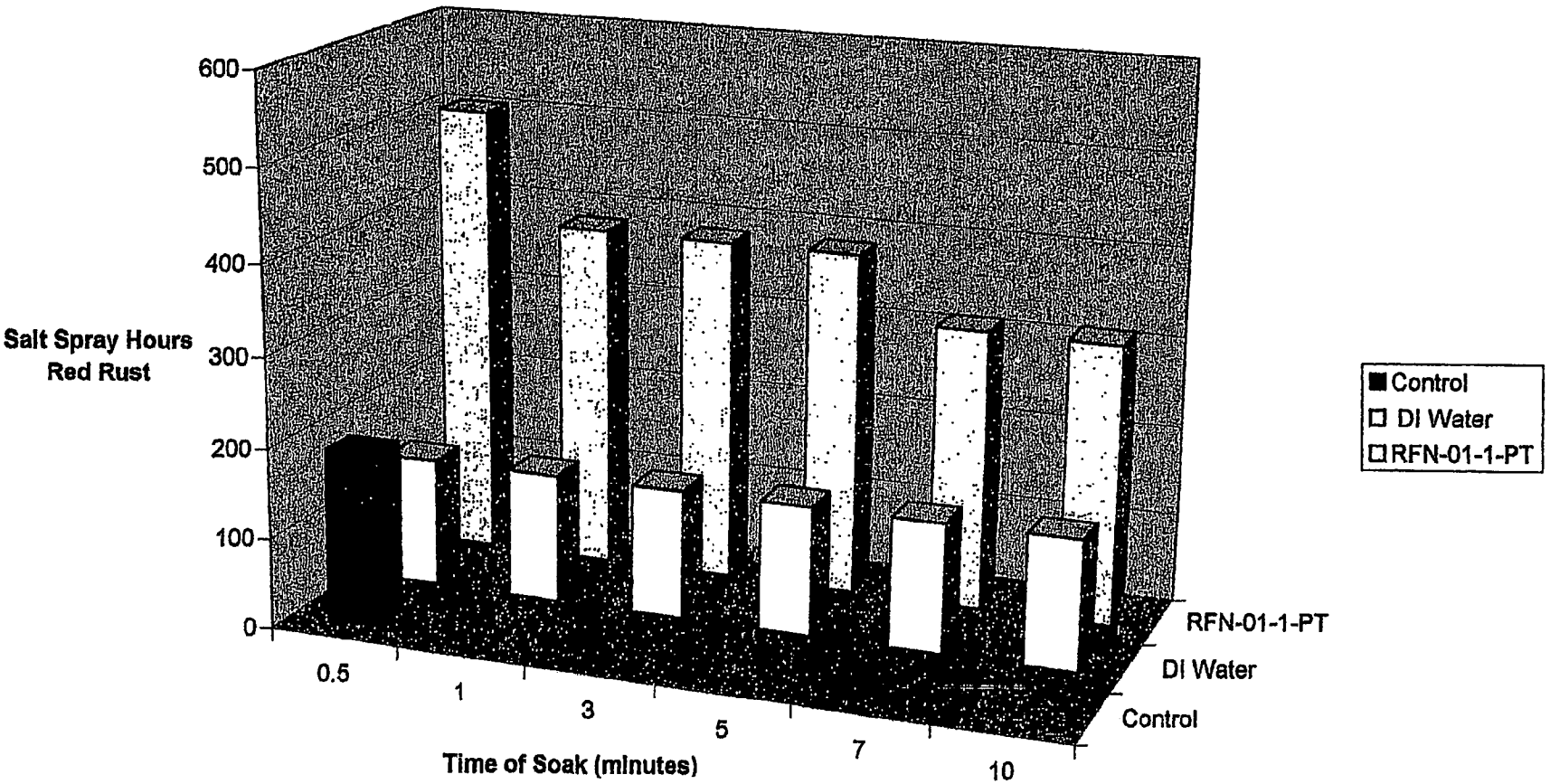
FIG. 2 is a graph illustrating corrosion resistance of metal samples soaked and coated for various time periods at 65° C. (150° F.) and air dried.
Figure 3:
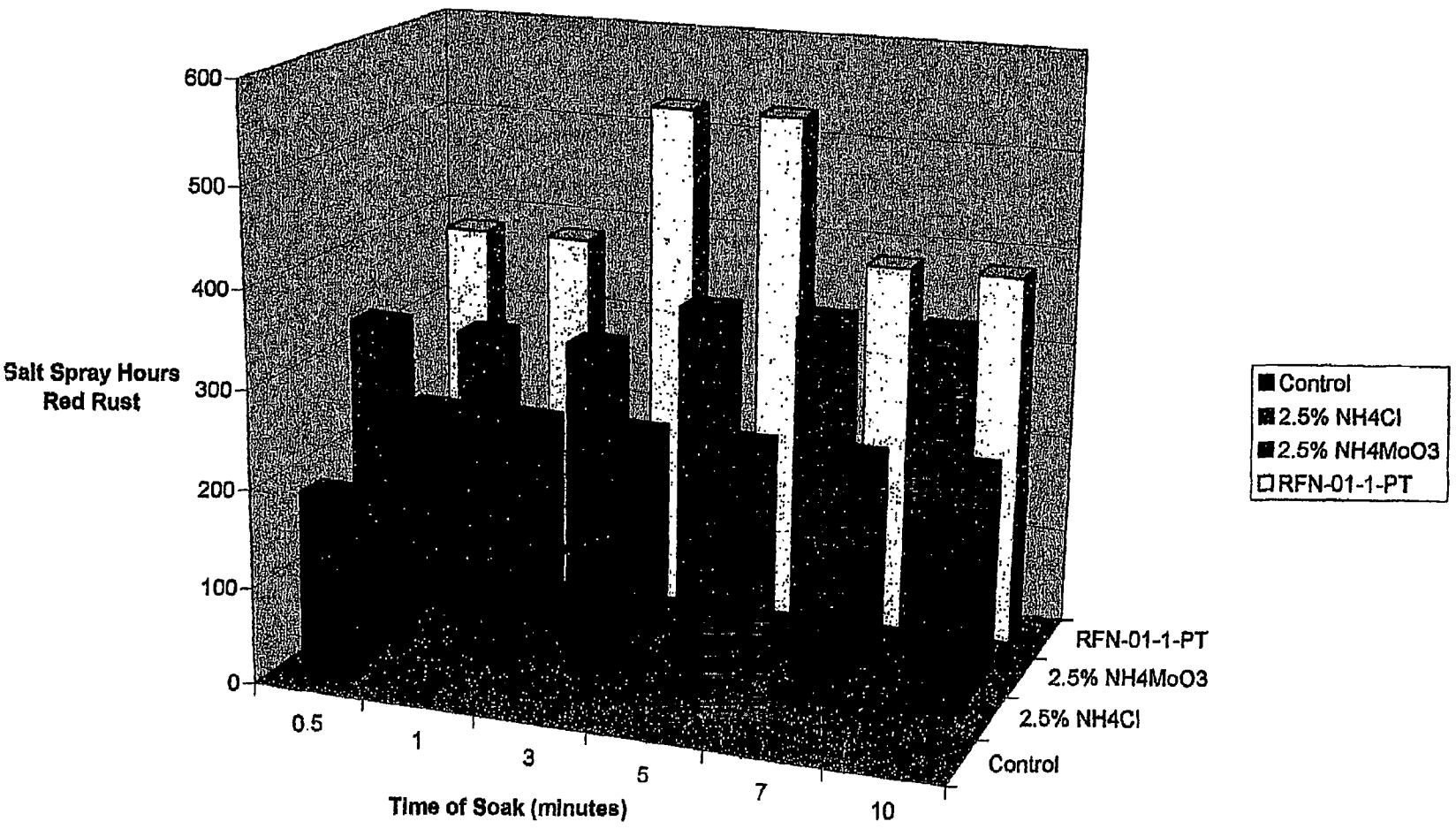
FIG. 3 is a graph illustrating corrosion resistance of metal samples soaked and coated for various time periods at room temperature and dried at 177° C. (350° F.).
Figure 4:
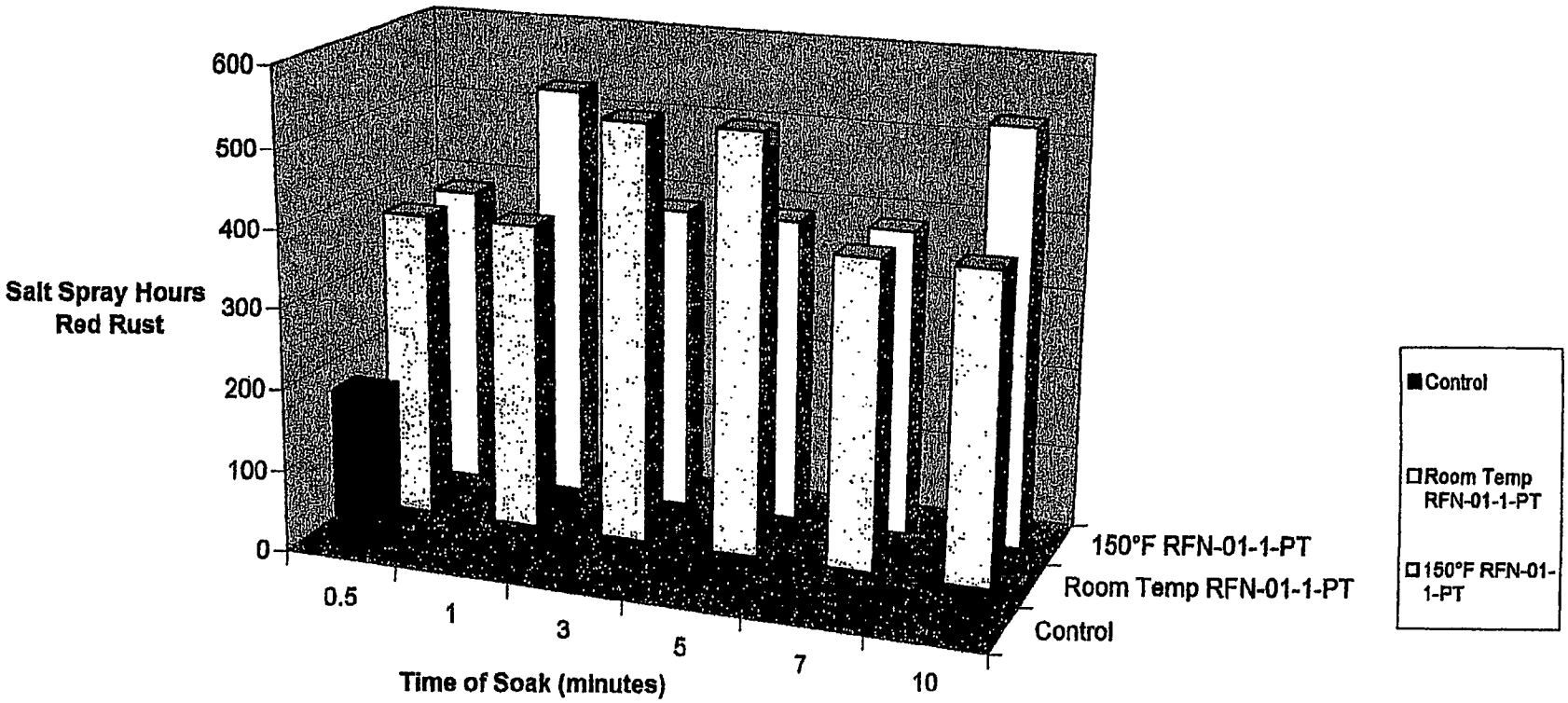
FIG. 4 is a graph illustrating corrosion resistance of metal samples coated and dried at 177° C. (350° F.).
Figure 5:
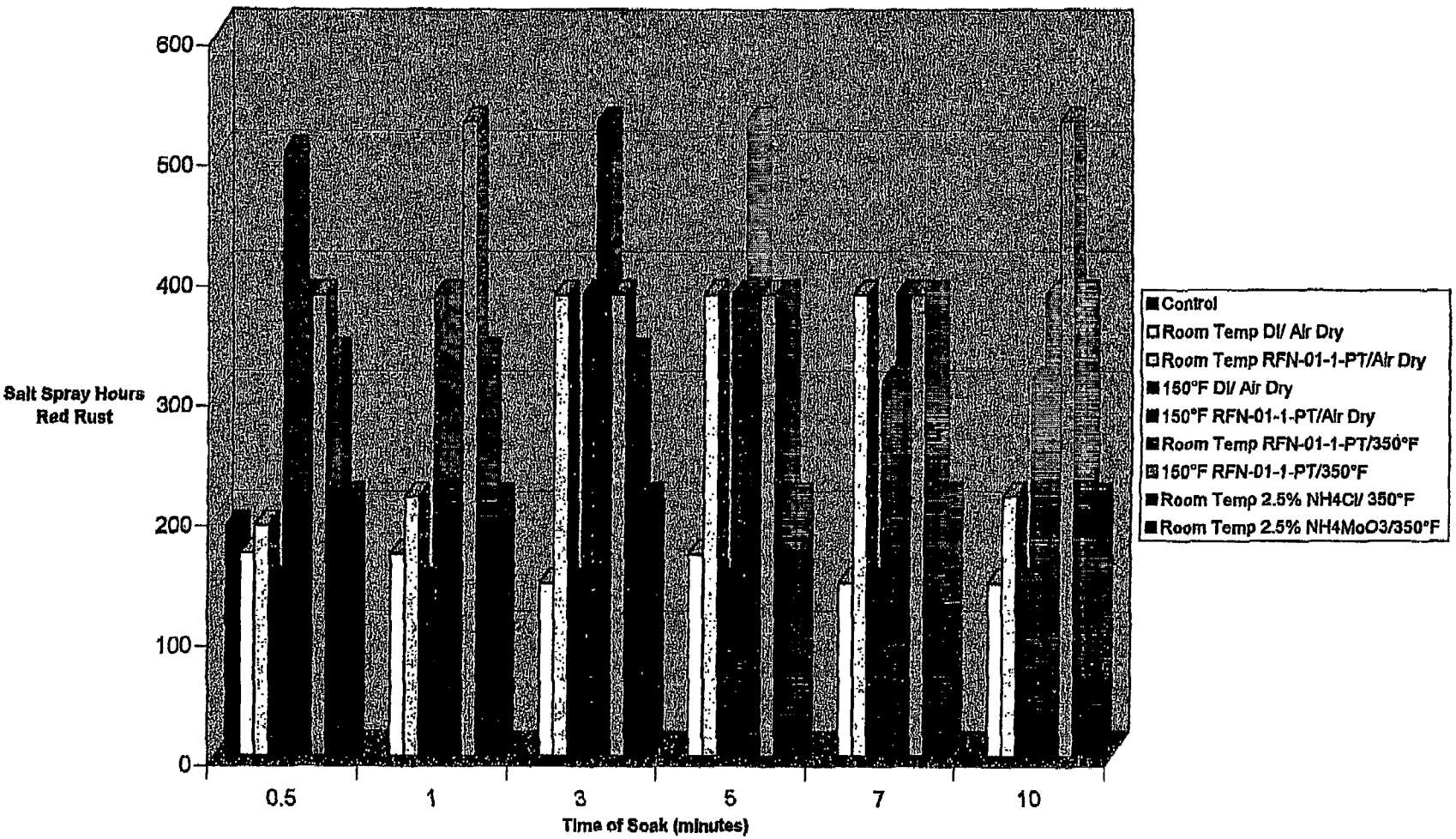
FIG. 5 is a comparison of metal samples coated in accordance with the present invention with uncoated, conventional samples.

The present invention provides methods and compositions for darkening the surface of a metal, and particularly zinc or other active metals. The invention also provides methods and compositions for imparting corrosion-resistant properties to metals such as zinc or other active metals. In a most preferred aspect, the present invention provides a composition that achieves both of these objectives. The invention also includes the resulting coated articles or products.

In a preferred embodiment, the present invention provides an aqueous solution comprising from about 0.1 percent to about 5.0 percent ammonium chloride and from about 0.1 percent to about 5.0 percent ammonium molybdate. All percentages noted herein are percentages by weight unless otherwise indicated. More preferably, the aqueous solution comprises from about 0.5 percent to about 3.0 percent ammonium chloride and from about 0.5 percent to about 3.0 percent ammonium molybdate. Most preferably, the aqueous solution comprises about 2.5 percent ammonium chloride and about 2.5 percent ammonium molybdate. It is contemplated that aqueous compositions according to the present invention may utilize significantly higher concentrations of ammonium molybdate since that component is relatively soluble in water. In contrast, ammonium chloride is significantly less soluble in water. Regardless of the particular concentration of ammonium chloride and ammonium molybdate utilized, it is most preferred that the concentrations of these two components be the same or substantially so. Dual benefits in coloring and corrosion resistance result when the concentrations of these components are approximately the same. Generally, it is preferred that the respective concentrations of these two components are from about 1:3 to about 3:1, preferably from about 1:2 to about 2:1, and most preferably about 1:1. These ratios are weight ratios and are given with regard to the ratio of ammonium chloride to ammonium molybdate, respectively. The balance of the preferred composition is water. The present invention composition may include other additives and components as described herein.

As previously noted, it is often desired to impart a black or dark color to various metal components, particularly those used in the automotive industry. Examples of such components include, but are not limited to, fasteners, door strikes, and related assemblies. And, as previously explained, it is also desired or necessary to coat such metal components with a corrosion-resistant or corrosion inhibiting coating. The composition of the present invention may be utilized either alone to provide a dark color and/or corrosion-resistant properties to a coated part, or in conjunction with one or more other coloring coatings or corrosion-resistant or corrosion inhibiting coatings. When utilized in conjunction with other coatings, the present invention composition may lead to cost savings since less of the other coating may be required, and may also provide increased corrosion resistance or corrosion inhibiting characteristics. These advantages are described in greater detail herein.

The assignee of the present invention offers several commercially available corrosion-resistant coatings under the trademarks Dacromet® and Geomet®. Dacromet® is an inorganic coating based upon zinc and aluminum flakes in an inorganic binder. Specific grades of Dacromet® include Dacromet 320® which contains low volatile organic compounds (VOCs); Dacromet 320 LC® which is a low chromium formulation; Dacromet 500® which is based upon the use of polytetrafluorethylene to provide consistent torque-tension characteristics; and Dacromet 320® HS which is formulated to provide a relatively thick and heavy coating. Geomet® is an aqueous coating dispersion containing zinc and aluminum flakes, with an inorganic binder system. Geomet® was formulated as an alternative, environmentally friendly corrosion-resistant coating. Geomet® is water-based, low in VOCs, and free of all highly regulated toxic metals including chromium, nickel, cadmium, barium and lead. Dacromet® and Geomet® products are available from Metal Coatings International, Inc., Chardon, Ohio, and also through numerous licensees thereof. Further descriptions of corrosion-inhibiting coatings are described in U.S. Pat. Nos. 3,907,608; 4,555,445; 4,645,790; 4,891,268; 4,799,959; 5,006,597; 5,868,819; 6,270,884; and 6,361,872; all of which are hereby incorporated by reference.

If the present invention composition is used in conjunction with one or more corrosion-resistant coatings, such as previously noted or with one or more coloring or pigment-containing compositions, it is preferred to apply the present invention coating to the uncoated and exposed metal surface, prior to application of the corrosion-resistant coating and/or the coloring coating. Application of the present invention coating provides a base layer of a corrosion-resistant coating. In addition, the layer of the present invention composition provides a dark coloring over the metallic and often silvery or shiny appearance of the underlying metal. Thus, upon subsequent application of a corrosion-resistant coating, such as a Geomet® coating, coverage is typically further improved with minimal or no indication of the metallic surface underneath. Furthermore, metallic components that are first coated with the present invention composition prior to receiving a coating of a corrosion-resistant material, generally provide a more durable and longer lasting black or dark color than if only coated with the corrosion-resistant material. The reason for this is that parts not coated with the present invention composition, and only coated with a corrosion-resistant material, if scraped, often display the silvery or shiny metallic surface directly under the corrosion-resistant material. Instead, if such part is first coated with the present invention composition, is the coated part is black or dark in color. And so, after further application of a corrosion resistant coating, upon scraping of that part, if a region of the corrosion-resistant coating is removed, instead of the shiny metallic surface being exposed, the black or dark color of the present invention composition is exposed. This is much less noticeable as compared to the underlying metallic surface.

The present invention also includes methods in which the inventive compositions are applied onto the outer layer of a coated surface, such as the outer surface of a metal part previously coated with a Geomet® formulation. That is, the present invention composition may be used as a top coat or as an outer coating. Many of the parts described in the discussion of testing results herein, were first coated with Geomet®, prior to application of a preferred composition according to the present invention. Significant anti-corrosion benefits resulted. Although not wishing to be bound to any particular theory, it is believed that the presence of one or more active metals in the previously deposited coating, assists in the adherence of the coating of the present invention. Therefore, for those applications in which the present invention composition is applied onto a previously coated metal substrate, it is preferred that the underlying coating contain an effective amount of one or more active metals. However, it will be appreciated that the present invention includes application of the inventive compositions upon a coated metal substrate in which the coating does not contain any active metals.

Additionally, the present invention composition and associated methods also include strategies in which the inventive composition is used as an intermediate coating or layer. That is, the present invention composition may be applied on a coated substrate, and then one or more additional coatings applied thereon. For instance, a metal substrate may be first coated with an anti-corrosion composition such as a Geomet® formulation. Then, the present invention composition may be applied onto the layer of Geomet®. After that, one or more additional coatings or layers of other formulations may be applied on the previously applied layer of the present invention composition. Examples of additional coatings that may be applied on a previously applied layer of the present invention composition include, but are not limited to Dacrokote® 50 Clear, Dacrokote® 105, Dacrokote® 107, Dacrokote® 127, Dacrokote® 135, Geokote® 137, Geokote® 147, Geokote® 200, and Plus® L, all of which are commercially available from Metal. Coatings International, Inc., and also through numerous licensees thereof. Descriptions of forming such multi-layer coating systems are provided in the discussion of testing results herein.

As noted, the present invention composition may be used alone or in conjunction with other compositions to provide both a dark color and corrosion protection to a metal surface. As will be appreciated, the determination of whether to use the present invention composition alone or in conjunction with one or more corrosion-resistant coatings and/or coloring compositions depends upon the application and desired properties of the coated component.

The preferred embodiment composition comprises ammonium chloride and ammonium molybdate. Although not wishing to be bound to any particular theory, it is believed that the ammonium chloride serves as an etchant to the metal surface to be coated. For example, for a zinc surface, the ammonium chloride attacks the zinc substrate and dissolves an outermost, exposed layer of zinc. The molybdate ion from the ammonium molybdate then reacts with the exposed zinc surface to form insoluble zinc molybdate or zinc molybdate oxide compounds upon the exposed zinc surface. The resulting zinc molybdate or zinc molybdate oxide compounds that are formed are believed to be passivators. The formation of these insoluble compounds creates a black or dark color. The dark color is a result of the mixed oxidation state of molybdate. As previously noted, the dark color renders the coated part eligible for subsequent coatings with one or more corrosion resistant coatings such as Geomet®.

Although the preferred compositions of the present invention are aqueous, the present invention includes compositions that contain one or more organic components. The term "aqueous" as used herein refers to water or water-based and includes, but is not limited to, tap water, distilled water, and deionized water. The organic component of the coating composition is preferably a low-boiling organic liquid, although there may be present some high-boiling organic liquids, so that the liquid medium may include mixtures of the foregoing. Suitable coating compositions can also be produced that contain low-boiling organic liquid, while retaining desirable composition characteristics, such as composition stability. The low-boiling organic liquids have a boiling point at atmospheric pressure below about 100° C. (212° F.), and are preferably water-soluble. Such low-boiling organic liquids may be represented by acetone, or low molecular weight alcohols such as methanol, ethanol, n-propylalcohol and isopropylalcohol, and further include ketones that boil below 100° C. (212° F.), such as water-soluble ketones, e.g., methyl ethyl ketone.

Generally, for compositions that comprise one or more organic components, the organic component-will be present in an amount from about 1 to about 30 percent, basis total composition weight. Presence of such organic liquid, particularly in amounts above about 10 percent, e.g., at 15 to 25 percent, may enhance the corrosion-resistance of the coating, but use of greater than about 30 percent can become uneconomical. Preferably, for economy plus ease of composition preparation, acetone will supply the low-boiling organic liquid and will be present in an amount between about 1 and about 10 percent of the total composition. Further examples of suitable low-boiling organic liquids and high-boiling organic liquids are provided in U.S. Pat. Nos. 5,868,819 and 6,270,884; both of which are herein incorporated by reference.

Yet another advantage of the present invention composition is that coatings of the composition prevent or at least significantly reduce, white corrosion products from bleeding through the coated part. For coated parts that are black or dark in color, the appearance of white corrosion is particularly noticeable and detrimental. As will be appreciated, white corrosion or white rust is generally associated with zinc corrosion products. Red rust is generally associated with steel or iron corrosion products.

The present invention composition may comprise other compounds besides or in addition to ammonium chloride and ammonium molybdate. Similarly, other sources of molybdate ion may be used instead of or in addition to ammonium molybdate. Examples of suitable molybdate ion sources include, but are not limited to magnesium molybdate, lithium molybdate, sodium molybdate, potassium molybdate, rubidium molybdate, and cesium molybdate. The term "ammonium molybdate" includes ammonium dimolybdate and ammonium heptamolybdate. Depending upon the particular application and characteristics of the solution, it is also contemplated to utilize molybdic acid as a source, either partially or entirely, for the molybdate ion. The specific concentration of the molybdate ion in the system may vary depending upon the degree of hardness of the aqueous system, the temperature, and the amount of dissolved oxygen in the aqueous system.

The present invention composition may also comprise additional agents such as fluoride compounds for instance sodium fluoride, to promote etching of the zinc surface. It is also contemplated to include one or more oxidants or peroxides.

Furthermore, the present invention composition may also comprise additional agents such as, but not limited to, wetting agents, pH modifiers, thickeners or viscosity adjusters. Suitable wetting agents or mixture of wetting agents can include nonionic agents such as the nonionic alkylphenol polyethoxy adducts, for example. Also, there can be used anionic wetting agents, and these are most advantageously controlled foam anionic wetting agents. Serviceable such wetting agents or mixture of wetting agents can include anionic agents such as organic phosphate esters, as well as the diester sulfosuccinates as represented by sodium bistridecyl sulfosuccinate. The amount of such wetting agent is typically present in an amount from about 0.01 to about 3 percent of the total coating composition.

It is contemplated that the composition may contain a pH modifier, which is able to adjust the pH of the final composition. Where a modifier is used, the pH modifier is generally selected from the oxides and hydroxides of alkali metals, with lithium and sodium as the preferred alkali metals for enhanced coating integrity; or, it is selected from the oxides and hydroxides usually of the metals belonging to the Groups IIA and IIB in the Periodic Table, which compounds are soluble in aqueous solution, such as compounds of strontium, calcium, barium, magnesium, zinc and cadmium. The pH modifier may also be another compound, e.g., a carbonate or nitrate, of the foregoing metals.

The coating composition may also contain thickener. The thickener, when present, can contribute an amount of between about 0.01 to about 2.0 percent of thickener, basis total composition weight. This thickener can be a water-soluble cellulose ether, including the Cellosize™ thickeners. Suitable thickeners include the ethers of hydroxyethylcellulose, methylcellulose, methylhydroxypropylcellulose, ethylhydroxyethylcellulose, methylethylcellulose or mixtures of these substances. Although the cellulose ether needs to be water soluble to augment thickening of the coating composition, it need not be soluble in the organic liquid. When thickener is present, less than about 0.02 percent of the thickener will be insufficient for imparting advantageous composition thickness, while greater than about 2 percent of thickener in the composition can lead to elevated viscosities which provide compositions that are difficult to work with. Preferably, for the best thickening without deleterious elevated viscosity, the total composition will contain from about 0.1 to about 1.2 percent of thickener. It will be understood that although the use of a cellulosic thickener is contemplated, and thus the thickener may be referred to herein as cellulosic thickener, some to all of the thickener may be another thickener ingredient. Such other thickening agents include xanthan gum, associative thickeners, such as the urethane associative thickeners and urethane-free nonionic associative thickeners, which are typically opaque, high-boiling liquids, e.g., boiling above 100° C. (212° F.). Other suitable thickeners include modified clays such as highly beneficiated hectorite clay and organically modified and activated smectite clay, although such is not preferred. When thickener is used, it is usually the last ingredient added to the formulation.

Additionally, depending upon the application, the present invention composition may also include one or more lubricants such as, but not limited to wax; polymeric materials such as polyethylene, copolymers incorporating polyethylene, or polytetrafluorethylene; graphite; molybdenum disulfide; or combinations thereof.

A further advantage of the present invention composition is that, if desired, the composition may be pigment free and/or colorless prior to application to the metal surface. This feature stems from the fact that the dark color of coatings of the present invention composition after application is due to the mixed oxidation states of the resulting molybdenum compounds formed on the substrate, and not a result of pigment in the composition. Prior to application, the present invention composition is generally transparent or colorless. However, it will be appreciated that the present invention compositions may, if desired, include one or more pigments or coloring agents.

The present invention compositions and methods may be used in conjunction with a wide array of metal surfaces. For example, nearly any active metal may be coated as described herein. Preferred metals include, but are not limited to magnesium, aluminum, zinc, manganese, and alloys containing these metals. Most preferably, the metal surface to be coated in accordance with the present invention is zinc. By a "zinc" surface it is meant a surface of zinc or zinc alloy, or a metal such as steel coated with zinc or zinc alloy, as well as a substrate containing zinc in intermetallic mixture. The term "zinc" surface also includes surfaces of coatings that contain zinc or zinc compounds.

Before coating, it is in most cases advisable to remove foreign material from the substrate surface, such as by thoroughly cleaning and degreasing. Degreasing may be accomplished with known agents, for instance, with agents containing sodium metasilicate, caustic soda, carbon tetrachloride, trichlorethylene, and the like. Commercial alkaline cleaning compositions which combine washing and mild abrasive treatments can be employed for cleaning, e.g., an aqueous trisodium phosphate-sodium hydroxide cleaning solution. In addition to cleaning, the substrate may undergo cleaning plus etching, or cleaning plus hot blasting.

The present invention composition may be applied in a variety of fashions, including but not limited to dip coating, rolling, or spraying. Generally, the coating compositions may be applied by any of these various techniques, such as immersion techniques, including dip drain and dip spin procedures. Depending upon the application, the coating compositions can be applied by curtain coating, brush coating or roller coating and including combinations of the foregoing. It is also contemplated to use spray techniques as well as combinations, e.g., spray and spin and spray and brush techniques. Coated articles that are at an elevated temperature may be coated, often without extensive cooling, by a procedure such as dip spin, dip drain or spray coat. Depending upon the technique, several considerations should be noted. Spraying or otherwise administering the composition onto an exposed metal or coated surface is generally the simplest technique, since the composition of the feed remains constant throughout the application. In contrast, when a preset or fixed amount of the composition is used in a dip coating operation, the composition and concentration of its constituents change over time since formation of the coating is reactive in nature. For instance, upon dipping a zinc part in a bath of the present invention composition, an amount of zinc is etched or removed from the part and displaced into the bath. Concurrently, molybdate from the bath is used in the formation of the insoluble coating that forms on the exposed zinc part. And, various ammonium compounds and precipates may form, further altering the composition of the bath. Therefore, it is preferred that controls or other monitoring methods be used to ensure that the concentration of at least the molybdate ion in the bath is maintained at an acceptable level.

After application of the coating composition to the metal or coated metal, it is preferred for best corrosion-resistance to subsequently heat-cure the applied coating. However, volatile coating substances may be initially simply evaporated from any of the applied coatings, e.g., by drying before curing. Cooling after drying may be obviated. The temperature for such drying, which may also be referred to as precuring, can be within the range from about 37° C. (100° F.) to about 121° C. (250° F.). Depending upon the application, higher temperatures may be employed. Drying times can be on the order of from about 2 to about 25 minutes, or longer.

Any elevated temperature curing of a coating composition on a substrate will often be a hot air oven cure, although other curing procedures can be used, e.g., infrared baking and induction curing. The coating composition can be heat-cured at elevated temperature, e.g., on the order of about 232° C. (450° F.), but usually greater, oven air temperature. The cure will typically provide a substrate temperature, usually as a peak metal temperature, of at least about 232° C. (450° F.). Oven air temperatures may be more elevated, such as on the order of 343° C. (650° F.) or more.

Curing, such as in a hot air convection oven, can be carried on for several minutes. Although cure times may be less than 5 minutes, they are more typically on the order of from at least about 10 to about 45 minutes. It is to be understood that cure times and temperatures can be effected where more than one layer of coating is applied or when there may be a subsequently applied topcoating that is a heat-cured topcoating. Thus, shorter time and lower temperature cures may be employed. Also, where more than one coating is applied, or with a heat-curable topcoating, the coating may only need be dried, as discussed hereinabove. Then, curing can proceed after application of the heat-cured topcoating.

Testing

A series of tests were conducted to further evaluate the present invention compositions and methods. In particular, a variety of parts coated with commercially available corrosion-inhibiting compositions were compared to corresponding parts also coated with the same corrosion-inhibiting compositions and further coated with a coating of the present invention. These trials are as follows.

In many of these trials, various parts and coated samples were subjected to salt sprays of varying duration. Exposure to such sprays and the effects thereof provide an insightful indication as to the corrosion resistance characteristics of the part or coated sample. All salt spray testing described herein was performed in accordance with ASTM B117. Corrosion resistance of coated parts was measured by means of the standard salt spray (fog) test for paints and varnishes as set forth in ASTM B-117. In this test, the parts are placed in a chamber kept at constant temperature where they are exposed to a fine spray (fog) of a 5 percent salt solution for specified periods of time, rinsed in water and dried. The extent of corrosion of the test parts can be expressed as percent of red rust.

A. Trial No. 1

Two coats of Geomet® coated on 40 mm bolts as described below, were used in this first trial. The bolts were coated by placing in a wire basket and dipping the basket into the Geomet® coating composition, removing the basket and draining excess composition therefrom. The bolts and basket were then dip spun. During dip spinning, the basket was spun at 300 rpm for 10 seconds forward and 10 seconds reverse.

Draining was followed by baking. The bolts were placed on a sheet for baking. Baking was performed at an air temperature of about 121° C. (250° F.) for a time up to 10 minutes and then at 232° C. (450° F.) for 30 minutes. The bolts were coated twice with the coating composition using this procedure.

The Geomet® parts were used as the control with a coat weight of 33.7 g/m$^2$. The post-treatment used a preferred embodiment composition in accordance with the present invention, designated as RFN-01-1-PT. The formulation of this composition is set forth in Table 1, and contains 2.5 percent ammonium chloride and 2.5 percent ammonium molybdate in 95 percent water. A bath was also prepared that contained only 2.5 percent ammonium molybdate. Another bath was prepared that contained only 2.5 percent ammonium chloride. Parts were soaked in the baths for different amounts of time, ranging from 30 seconds to 10 minutes. A de-ionized water only bath and the RFN-01-1-PT bath were applied to the coated parts when the baths were at room temperature and 65° C. (150° F.) for comparison in salt spray. After application of the de-ionized water and RFN-01-1-PT baths, the parts were air dried 24 hours before salt spray testing. The RFN-01-1-PT bath, the 2.5 percent ammonium chloride only bath, and the 2.5 percent ammonium molybdate only bath were applied at room temperature and the parts dried for 5 minutes at 177° C. (350° F.). The RFN-01-1-PT bath was also applied at room temperature and 65° C. (150° F.) and then dried at 177° C. (350° F.) for 5 minutes.

TABLE 1

| RFN-01-1-PT | |
|---|---|
| Component | Weight Percent |
| DI Water | 95.00 |
| Ammonium Chloride | 2.50 |
| Ammonium Molybdate | 2.50 |
| Total | 100.00 |

TABLE 2

| | Hours of Salt Spray Prior to Red Rust | | | | | | |
|---|---|---|---|---|---|---|---|
| Soak Minutes | 0 | 0.5 | 1 | 3 | 5 | 7 | 10 |
| Room Temp Bath/ Air Dry | | | | | | | |
| Control | 192 | | | | | | |
| DI Water | | 168 | 168 | 144 | 168 | 144 | 144 |
| RFN-01-1-PT | | 192 | 216 | 384 | 384 | 384 | 216 |
| 150° F. Bath Temp/ Air Dry | | | | | | | |
| Control | 192 | | | | | | |
| DI Water | | 144 | 144 | 144 | 144 | 144 | 144 |
| RFN-01-1-PT | | 504 | 384 | 384 | 384 | 312 | 312 |
| Room Temp bath/ 350° F. Dry | | | | | | | |
| Control | 192 | | | | | | |
| 2.5% NH4Cl | | 336 | 336 | 336 | 384 | 384 | 384 |
| 2.5% NH4Mo03 | | 216 | 216 | 216 | 216 | 216 | 216 |
| RFN-01-1-PT | | 384 | 384 | 528 | 528 | 384 | 384 |
| 350° F. Dry | | | | | | | |
| Control | 192 | | | | | | |
| Room Temp RFN-01-1-PT | | 384 | 384 | 528 | 528 | 384 | 384 |
| 150° F. RFN-01-1-PT | | 384 | 528 | 384 | 384 | 384 | 528 |

The data in Table 2 is graphically illustrated in FIGS. 1-5.

The data clearly demonstrates that post-treatment, i.e. application of the preferred embodiment composition, applied by any means improved the performance and corrosion resistance properties of Geomet® in salt spray.

B. Trial No. 2

In yet another series of trials, brake rotors previously coated with Geomet® were further coated with the preferred embodiment composition and subjected to various testing as follows.

The rotors were cleaned with acid or alkaline cleaners. The alkaline cleaned rotors were immersed in Metal Cleaner 478 alkaline cleaner for 15 minutes at 65° C. (150° F.). The rotors were then rinsed in tap water followed by acetone before application of the Geomet® coating. The acid cleaned rotors were first cleaned using the alkaline cleaner method listed above followed by 7 minutes in Madison Chemical Acid 162 at 48° C. (120° F.). The acid cleaned rotors were then rinsed in tap water followed by Madison Chemical DX 1100 de-smutter for 3 minutes at room temperature. The rotors were rinsed in tap water and then acetone prior to Geomet® application. The Geomet® was sprayed onto the rotors. The rotors were warmed in a 65° C. (150° F.) oven for 5 minutes before application of RFN-01-1-PT. The composition of RFN-01-1-PT is set forth in Table 1. The RFN-01-1-PT was sprayed and dip drained onto rotors. Rotors B and G were rinsed with water after applying RFN-01-1-PT. Rotors 2 and 8 were not rinsed with water following application of RFN-01-1-PT. Table 3, set forth below, lists the various rotors, manner of coating, and resulting coating thickness.

TABLE 3

| Parts, Coatings and Film Thickness | | | | |
|---|---|---|---|---|
| Rotor | Coating | Film Thickness (Microns) | Deviation | Cleaning |
| B | | | | Acid |
| Brake Surface Up | | 7.64 | 0.94 | |
| Brake Surface Down | GEOMET and RFN-01-1-PT | 7.10 | 0.95 | |
| Mating Surface Up | Dip Drain RFN-01-1-PT | 11.19 | 1.61 | |
| G | | | | Acid |
| Brake Surface Up | GEOMET and RFN-01-1-PT | 8.10 | 0.93 | |
| Brake Surface Down | Spray RFN-01-1-PT | 7.26 | 1.81 | |
| Mating Surface Up | | 12.16 | 2.02 | |
| 1 | | | | Alkaline |
| Brake Surface Up | GEOMET | 6.03 | | |
| Brake Surface Down | | 6.66 | | |
| Mating Surface Up | | 6.64 | | |
| 13 | | | | Acid |
| Brake Surface Up | GEOMET | 6.27 | | |
| Brake Surface Down | | 7.63 | | |
| Mating Surface Up | | 6.91 | | |
| 2 | | | | Alkaline |
| Brake Surface Up | GEOMET and RFN-01-1-PT | 6.59 | | |
| Brake Surface Down | Dip Drain RFN-01-1-PT | 7.54 | | |
| Mating Surface Up | | 7.09 | | |
| 8 | | | | Alkaline |
| Brake Surface Up | GEOMET and RFN-01-1-PT | 6.15 | | |
| Brake Surface Down | Spray RFN-01-1-PT | 6.99 | | |
| Mating Surface Up | | 7.35 | | |

The coated rotors were then subjected to salt spray testing as previously described.

TABLE 4

| Salt Spray Testing | | | | | | | |
|---|---|---|---|---|---|---|---|
| | Salt Spray Hours | | | | | | |
| Rotor | 144 | 240 | 360 | 480 | 576 | 720 | 1004 |
| B | 5 | no rust | no rust | no rust | no rust | 1 to 2% rust | 10% rust |
| G | 5 | no rust | no rust | no rust | no rust | <1% rust | 3% rust |
| 1 | <1% rust | 2% rust | 5 to 10% rust | 15 to 20% rust | pulled | | |
| 13 | 1 to 3% rust | 5 to 10% rust | 15 to 20% rust | 50% rust | pulled | | |
| 2 | no rust | no rust | no rust | no rust | no rust | ongoing | |
| 8 | no rust | no rust | no rust | no rust | no rust | ongoing | |

Figure 6:
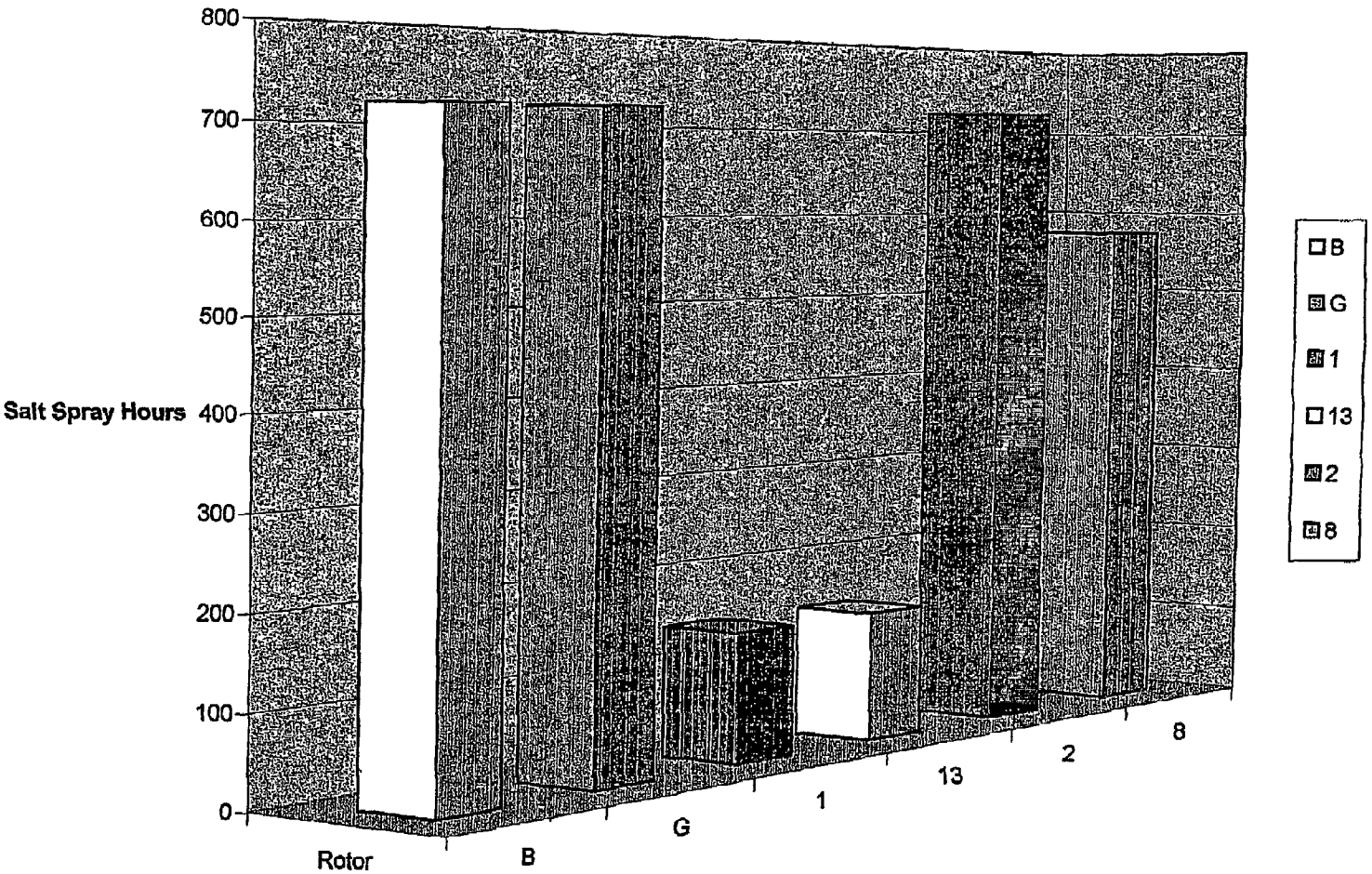
FIG. 6 is another comparison of metal samples coated in accordance with the present invention, illustrating varying degrees of corrosion resistance.

The data in Table 4 is graphically illustrated in FIG. 6.

Geomet® rotors cleaned using alkaline cleaner produced better corrosion resistance in salt spray testing then Geomet® rotors cleaned in acid, with or without a post-treatment in RFN-01-1-PT. And, the data clearly demonstrates that application of the preferred embodiment composition significantly increases corrosion resistance.

C. Trial No. 3

In another series of trials, automotive door strikers were coated and tested in various fashions. Samples of strikers were coated with various commercially available coatings and were used for comparison against strikers coated in accordance with the present invention. Parts with one coat of Geomet® applied were also tested against parts with two coats of Geomet®.

The preferred embodiment post-treatment solution, designated herein as RFN-01-1-PT, set forth in Table 1, was prepared for application to the door strikers coated with Geomet®. The treatment was applied by immersing the parts in the solution for 3 minutes, rinsing with de-ionized water, and drying with compressed air.

Parts were topcoated by a dip-spin method, at various speeds, depending on the coating. All parts were cured at 177° C. (350° F.) for 20 minutes, except for those coated with Dacrokote® 107, which were cured at 121° C. (250° F.) for 20 minutes. Tables 5A and 5B list the coating variations.

TABLE 5A

| Door Strike Coating Variations | | | | |
|---|---|---|---|---|
| | 1st Coat | 2nd Coat | 3rd Coat | 4th Coat |
| A | Geomet ® | RFN-01-1PT | Dacrokote ® 105 | |
| B | Geomet ® | RFN-01-1PT | Dacrokote ® 105 | Dacrokote ® 105 |
| C | Geomet ® | RFN-01-1PT | Dacrokote ® 107 | |
| D | Geomet ® | RFN-01-1PT | Dacrokote ® 107 | Dacrokote ® 107 |
| E | Geomet ® | RFN-01-1PT | Geokote ® 147 | |
| F | Geomet ® | RFN-01-1PT | Geokote ® 147 | Geokote ® 147 |
| G | Geomet ® | RFN-01-1PT | Geokote ® 200 | |
| H | Geomet ® | RFN-01-1PT | Geokote ® 200 | Geokote ® 200 |
| I | Geomet ® | RFN-01-1PT | | |
| J | Geomet ® | RFN-01-1PT | | |
| K | Geomet ® | Plus ® L | | |
| L | Geomet ® | RFN-01-1PT | Plus ® L | |
| M | Geomet ® | RFN-01-1PT | Dacrokote ® 105 | |
| N | Geomet ® | RFN-01-1PT | Geokote ® 200 | |
| O | Geomet ® | RFN-01-1PT | Plus ® L | |
| P | Geomet ® | RFN-01-1PT | Dacrokote ® 107 | |
| Q | Geomet ® | RFN-01-1PT | | |

TABLE 5B

| Door Strike Coating Variations | | | | | |
|---|---|---|---|---|---|
| | 1st Coat | 2nd Coat | 3rd Coat | 4th Coat | 5th Coat |
| R | Geomet ® | Geomet ® | RFN-01-1PT | Dacrokote ® 105 | |
| S | Geomet ® | Geomet ® | RFN-01-1PT | Dacrokote ® 105 | Dacrokote ® 105 |
| T | Geomet ® | Geomet ® | RFN-01-1PT | Dacrokote ® 107 | |
| U | Geomet ® | Geomet ® | RFN-01-1PT | Dacrokote ® 107 | Dacrokote ® 107 |
| V | Geomet ® | Geomet ® | RFN-01-1PT | Geokote ® 147 | |
| W | Geomet ® | Geomet ® | RFN-01-1PT | Geokote ® 147 | Geokote ® 147 |
| X | Geomet ® | Geomet ® | RFN-01-1PT | Geokote ® 200 | |
| Y | Geomet ® | Geomet ® | RFN-01-1PT | Geokote ® 200 | Geokote ® 200 |
| Z | Geomet ® | Geomet ® | RFN-01-1PT | | |
| AA | Geomet ® | Geomet ® | Plus ® L | | |
| BB | Geomet ® | Geomet ® | RFN-01-1PT | Plus ® L | |
| CC | Geomet ® | Geomet ® | RFN-01-1PT | Geokote ® 200 | |
| DD | Geomet ® | Geomet ® | RFN-01-1PT | Geokote ® 200 | Geokote ® 200 |
| EE | Geomet ® | Geomet ® | RFN-01-1PT | Plus ® L | |
| FF | Geomet ® | Geomet ® | RFN-01-1PT | | |

In summary, none of the parts with only one coat of Geomet® met the requirement of 360 hours in salt spray. Of those coated and treated with the preferred embodiment composition, the parts with one coat of Plus® L and those with one coat of Geokote® 200 fell 24 hours short of the requirement, with first red rust at 336 hours. See Table 6 for a summary of salt spray results for parts with one coat of Geomet®.

All of the parts with two coats of Geomet® met the 360-hour salt spray requirement, with the exception of the non-topcoated two-coat Geomet®, treated with the preferred embodiment composition, which first exhibited red rust at 216 hours. See Table 7 for the summary of two coat Geomet® parts' salt spray results.

Tables 6 and 7 contain numerical ratings corresponding to the percentage of red rust on the sample or part. The corrosion numbers in those tables indicate the extent of red rust as follows:

| Percentage Red Rust | Rating |
|---|---|
| 0-Trace | 5 |
| 1-5 | 4 |
| 6-15 | 3 |
| 16-25 | 2 |
| 26-50 | 1 |
| 51+ | 0 |

All of the parts tested had at least some degree of white rust on them, the heaviest of which appeared to be on parts with the black topcoats. Parts with no topcoat had less white rusting than the black parts. Parts topcoated with Plus® L had the least white rust.

Parts coated with two coats of Geomet® significantly outperformed those with one coat of Geomet®, regardless of the topcoat, or whether treated with the preferred embodiment composition. The two-coat parts in accordance with the present invention outperformed those having commercially available coatings, but this may be due at least in part to the higher coating weight of Geomet®.

Parts from variation O (one coat Geomet®, darkening solution, and Plus® L) outperformed variation K (one coat Geomet®, no darkening solution, and Plus® L), while K outperformed variation L (one coat Geomet®, darkening solution, and Plus® L). Parts from variations BB and EE (two coats Geomet®, darkening solution, and Plus® L) outperformed parts from variation AA (two coats Geomet®, no darkening solution, and Plus® L).

Thus, it is clear that in order to meet the salt spray requirement for these parts, two coats of Geomet® are preferred. Results also indicate that the preferred embodiment composition RFN-01-1-PT improves corrosion resistance, with the one exception of variation L.

TABLE 6

Salt Spray Results
One Coat Geomet ®

| | BASE COAT(S) | TOPCOAT | SALT SPRAY HOURS 72 | 96 | 120 | 144 | 288 | 312 | 336 | 408 | 432 | 456 | 480 | 504 |
|---|---|---|---|---|---|---|---|---|---|---|---|---|---|---|
| A | Geomet ® RFN-01-1-PT | Dacrokote ® 105 1110 mg/sq ft | 1.5 heavy | 1.0 | 1.0 | 0.0 heavy | 0.0 | — | — | — | — | — | — | — |
| B | Geomet ® RFN-01-1-PT | Dacrokote ® 105 1469 mg/sq ft | 2.0 light | 2.0 | 2.0 | 0.5 moderate | 0.0 | — | — | — | — | — | — | — |
| C | Geomet ® RFN-01-1-PT | Dacrokote ® 107 380 mg/sq ft | 3.5 moderate | | 2.5 | 1.5 moderate | 0.5 | — | — | — | — | — | — | — |
| D | Geomet ® RFN-01-1-PT | Dacrokote ® 107 1089 mg/sq ft | 3.0 light | | 3.0 | 1.0 moderate | 0.0 | — | — | — | — | — | — | — |
| E | Geomet ® RFN-01-1-PT | Geokote ® 147 422 mg/sq ft | 4.0 moderate | | 2.0 | 2.0 moderate | 1.0 | — | — | — | — | — | — | — |
| F | Geomet ® RFN-01-1-PT | Geokote ® 147 802 mg/sq ft | 4.5 light | | 3.5 | 3.0 moderate | 0.5 | — | — | — | — | — | — | — |
| G | Geomet ® RFN-01-1-PT | Geokote ® 200 452 mg/sq ft | 4.5 moderate | | 4.0 | 4.0 moderate | 2.5 | — | — | — | — | — | — | — |
| H | Geomet ® RFN-01-1-PT | Geokote ® 200 966 mg/sq ft | 5.0 light | | 4.5 | 4.0 light | 3.0 | — | — | — | — | — | — | — |
| J | Geomet ® RFN-01-1-PT | NONE | 1.5 moderate | | 0.0 | 0.0 | 0.0 | — | — | — | — | — | — | — |
| K | Geomet ® | Plus ® L 545 mg/sq ft | 5.0 light | | 5.0 | 5.0 light | 4.5 | 4.5 | 4.5 | 4.0 | 4.0 | 4.0 | 4.0 | 3.0 |
| L | Geomet ® RFN-01-1-PT | Plus ® L 442 mg/sq ft | 3.5 light | | 3.0 | 3.0 light | 2.0 | — | — | — | — | — | — | — |
| M | Geomet ® RFN-01-1-PT | Dacrokote ® 105 976 mg/sq ft | 5.0 heavy | | 4.0 | 3.5 heavy | 2.5 | — | — | — | — | — | — | — |
| N | Geomet ® RFN-01-1-PT | Geokote ® 200 966 mg/sq ft | 5.0 moderate | | 5.0 | 5.0 heavy | 5.0 | 5.0 | 4.0 | 3.5 | 3.0 | — | — | — |
| O | Geomet ® RFN-01-1-PT | Geokote ® 200 391 mg/sq ft | 5.0 light | | 5.0 | 5.0 moderate | 5.0 | 5.0 | 4.5 | 4.5 | 4.5 | 4.0 | 4.0 | 3.5 |
| P | Geomet ® RFN-01-1-PT | Plus ® L 555 mg/sq ft | 5.0 moderate | | 4.5 | 4.0 heavy | 3.0 | — | — | — | — | — | — | — |
| Q | Geomet ® RFN-01-1-PT | NONE | 4.5 Heavy | | 3.5 | 3.5 heavy | 2.5 | — | — | — | — | — | — | — |

Notes
A-L: Geomet applied at 14.3 g/sq m
M-Q: Geomet applied at 15.5 g/sq m
Light, Moderate, Heavy indicate degree of white rusting

TABLE 7

| | BASE COAT(S) | TOPCOAT | Salt Spray Results 2 Coats Geomet ® SALT SPRAY HOURS 216 | 360 | 384 | 480 | 504 | 624 | 792 | 840 |
|---|---|---|---|---|---|---|---|---|---|---|
| R | Geomet ® (2) RFN-01-1-PT | Dacrokote ® 105 904 mg/sq ft | 5.0 heavy | 5.0 | 5.0 | 5.0 | 5.0 | 5.0 | 5.0 | 4.5 heavy |
| S | Geomet ® (2) RFN-01-1-PT | Dacrokote ® 105 1778 mg/sq ft | 5.0 light | 5.0 | 5.0 | 5.0 | 5.0 | 5.0 | 5.0 | 5.0 heavy |
| T | Geomet ® (2) RFN-01-1-PT | Dacrokote ® 107 483 mg/sq ft | 5.0 moderate | 5.0 | 5.0 | 5.0 | 5.0 | 5.0 | 5.0 | 5.0 moderate |
| U | Geomet ® (2) RFN-01-1-PT | Dacrokote ® 107 894 mg/sq ft | 5 light | 5.0 | 5.0 | 5.0 | 5.0 | 5.0 | 5.0 | 5.0 moderate |
| V | Geomet ® (2) RFN-01-1-PT | Geokote ® 147 391 mg/sq ft | 5.0 moderate | 5.0 | 5.0 | 5.0 | 5.0 | 5.0 | 5.0 | 5.0 heavy |
| W | Geomet ® (2) RFN-01-1 -PT | Geokote ® 147 719 mg/sq ft | 5.0 light | 5.0 | 5.0 | 5.0 | 5.0 | 5.0 | 5.0 | 5.0 heavy |
| X | Geomet ® (2) RFN-01-1-PT | Geokote ® 200 473 mg/sq ft | 5.0 light | 5.0 | 5.0 | 5.0 | 5.0 | 5.0 | 5.0 | 5.0 heavy |
| Y | Geomet ® (2) RFN-01-1-PT | Geokote ® 200 894 mg/sq ft | 5.0 light | 5.0 | 5.0 | 5.0 | 5.0 | 5.0 | 5.0 | 5.0 heavy |
| Z | Geomet ® (2) RFN-01-1-PT | NONE | 5.0 moderate | 5.0 | 5.0 | 5.0 | 5.0 | 4.5 | 4.0 | 4.0 moderate |
| AA | Geomet ® Geomet ® | Plus ® L 493 mg/sq ft | 5.0 none | 5.0 | 5.0 | 5.0 | 4.0 | 3.5 | 3.5 | 3.5 light |
| BB | Geomet ® (2) RFN-01-1-PT | Plus ® L 462 mg/sq ft | 5.0 light | 5.0 | 5.0 | 5.0 | 5.0 | 5.0 | 5.0 | 5.0 light |
| CC | Geomet ® (2) RFN-01-1-PT | Geokote ® 200 385 mg/sq ft | 5.0 moderate | 5.0 | 4.5 | 4.5 | 4.0 | 3.0 | 2.0 | 1.5 heavy |
| DD | Geomet ® (2) RFN-01-1-PT | Geokote ® 200 899 mg/sq ft | 5.0 heavy | 5.0 | 5.0 | 4.5 | 4.5 | 4.0 | 2.0 | 2.0 heavy |
| EE | Geomet ® (2) RFN-01-1-PT | Plus ® L 411 mg/sq ft | 5.0 light | 5.0 | 5.0 | 5.0 | 5.0 | 4.0 | 3.0 | 3.0 light |
| FF | Geomet ® (2) RFN-01-1-PT | NONE | 4.0 moderate | 2.0 | 2.0 | 1.0 | 1.0 | 0.0 | 0.0 | 0.0 |

Notes
R-BB: Geomet applied at 14.3 g/sq m
CC-FF: Geomet applied at 15.5 g/sq m
Light, Moderate, Heavy indicate degree of white rusting The foregoing description is, at present, considered to be the preferred embodiments of the present invention. However, it is contemplated that various changes and modifications apparent to those skilled in the art, may be made without departing from the present invention. Therefore, the foregoing description is intended to cover all such changes and modifications encompassed within the spirit and scope of the present invention, including all equivalent aspects.

We claim:

1. A coated metallic substrate comprising:

a metal substrate having an outer surface, wherein said metal is selected from the group consisting of zinc, magnesium, manganese, and alloys and intermetallic mixtures thereof; and a darkening coating disposed on said substrate, said coating formed from an aqueous composition consisting essentially of (i) from about 0.1 percent to about 5 percent by weight ammonium chloride, and (ii) from about 0.1 percent to about 5 percent by weight ammonium molybdate, wherein the weight ratio of ammonium chloride to ammonium molybdate is from about 1:2 to about 2:1.

2. The coated substrate of claim 1 further comprising:

a corrosion-resistant coating disposed on said darkening coating, wherein said corrosion-resistant coating comprises zinc flakes and aluminum flakes dispersed in an inorganic binder.

3. The coated substrate of claim 1 wherein said ratio is about 1:1.

4. The coated substrate of claim 1 wherein the concentration of ammonium chloride is from about 0.5 percent to about 3 percent by weight.

5. The coated substrate of claim 1 wherein the concentration of ammonium chloride is about 2.5 percent by weight.

6. The coated substrate of claim 1 wherein the concentration of ammonium molybdate is from about 0.5 percent to about 3 percent by weight.

7. The coated substrate of claim 1 wherein the concentration of ammonium molybdate is about 2.5 percent by weight.

8. The coated substrate of claim 1 wherein the concentration of ammonium chloride is about 2.5 percent by weight and the concentration of ammonium molybdate is about 2.5 percent by weight.

9. The coated substrate of claim 1 further comprising;

a corrosion-resistant coating disposed between said outer surface of said metal substrate and said darkening coating, wherein said corrosion-resistant coating comprises zinc flakes and aluminum flakes dispersed in an inorganic binder.

10. The coated substrate of claim 1 wherein the metal is zinc.

11. The coated substrate of claim 1 wherein the metal is magnesium.

12. The coated substrate of claim 1 wherein the metal is manganese.

* * * * *